United States Patent [19]

Jacobson et al.

[11] Patent Number: 4,531,737

[45] Date of Patent: Jul. 30, 1985

[54] ELONGATED FOOTBALL

[76] Inventors: James Jacobson, 671 Barberry La., San Rafael, Calif. 94903; Thomas E. McCormick, P.O. Box 698, Ross, Calif. 94957

[21] Appl. No.: 574,527

[22] Filed: Jan. 27, 1984

[51] Int. Cl.[3] ..... A63B 43/00

[52] U.S. Cl. ..... 273/65 R; 273/65 EG; 273/65 B; 273/65 EC

[58] Field of Search ..... 272/77; 273/65 E, 65 B, 273/58 H, 55 R, 65 EC, 65 EB, 65 R, 58 B, 58 BA, 428

[56] References Cited

U.S. PATENT DOCUMENTS

| | | | |
|---|---|---|---|
| 1,240,866 | 9/1917 | Miller | 273/65 EG |
| 1,505,802 | 8/1924 | Pierce | 273/65 B |
| 2,197,545 | 4/1940 | Bachman et al. | 272/77 X |

*Primary Examiner*—George J. Marlo

*Attorney, Agent, or Firm*—Melvin R. Stidham

[57] ABSTRACT

An elongated football comprising a casing up to forty inches in length and no more than about six inches in diameter. There are three inflatable bladders contained in three compartments in tandem in the casing, each with its own inflating valve accessible from the outside of the casing so that it can be inflated to different pressures to vary the nature of the bounce. Soft putty may be added at each end of the football for adding weight thereto.

5 Claims, 3 Drawing Figures

ELONGATED FOOTBALL

BACKGROUND OF THE INVENTION

A standard football is approximately eleven inches in length and made up of four panels with a single row of lacing to function as a finger grip for passing the football. For effective use, said footballs must be fully inflated so that they are relatively hard and non-resilient. As so inflated, the standard football is often difficult for a person to grasp and, particularly in the case of those possessing relatively little skill in the techniques of the game, injuries can be sustained merely by mishandling the ball or being struck with it.

OBJECTS OF THE INVENTION

It is an object of this invention to provide an elongated football that can be easily gripped or grasped from either end.

It is a further object of this invention to provide an elongated football wherein each end thereof may be separately adjusted for resiliency.

It is a further object of this invention to provide an elongated football the bounce of which can be made even more unpredictable.

It is a further object of this invention to provide an elongated football which is relatively soft or resilient, for safe, carefree play.

Other objects and advantages of this invention become apparent from the description to follow, particularly when read in conjunction with the accompanying drawing.

SUMMARY OF THE INVENTION

In carrying out this invention, I provide an elongated football comprising a casing with several lengthwise panels interconnected by seam lines extending end to end. A row of laces or simulated laces are provided along each seam line at each end of the ball so that it can be gripped and thrown easily. Three inflatable bladders are contained within the casing, each within a separate compartment of the casing, and each having an inflation valve accessible from the outside of the casing so that each bladder may be inflated to a desired pressure, and all bladders are not necessarily at the same pressure.

DESCRIPTION OF A PREFERRED EMBODIMENT

Figure 1:
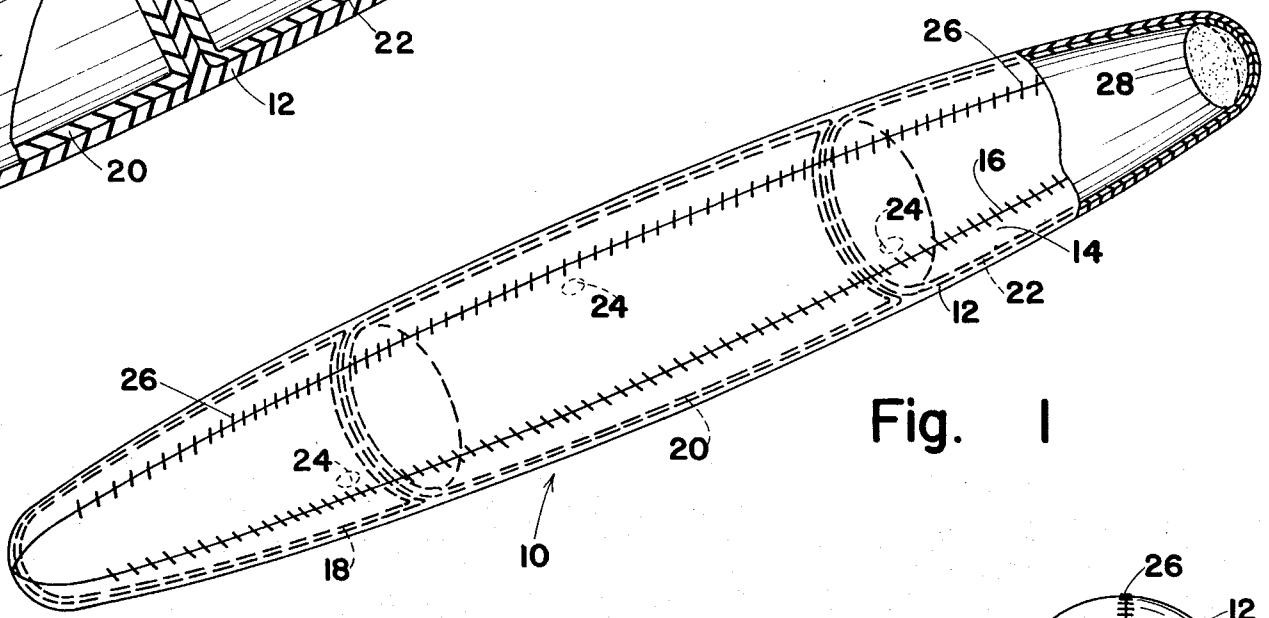
FIG. 1 is a view in perspective of an elongated football embodying features of this invention.
Figure 2:
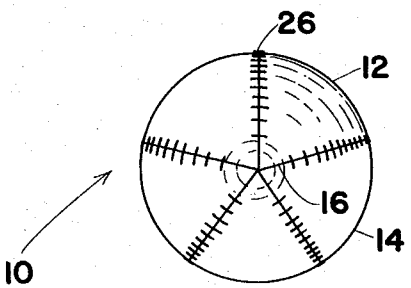
FIG. 2 is an end view of the football.
Figure 3:
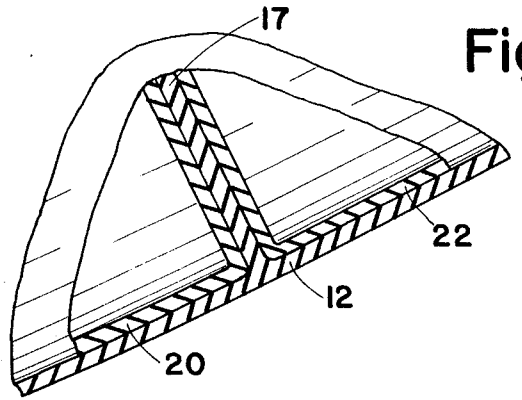
FIG. 3 is a partial section view of the football showing compartments of the casing and bladders contained therein.

Referring now to the drawing with greater particularity, the elongated football of this invention comprises a casing 12, of rubber, plastic, hide or the like, which is made up of five lengthwise panels 14 interconnected by seam lines 16 which extend from end to end, as in the conventional football. As shown in FIG. 3, the casing is compartmented by two or more partitions 17, and contained within the three compartments of the football are three inflatable bladders 18, 20 and 22, there being two generally conical end bladders 18 and 22 and one generally cylindrical middle bladder 20. Each bladder 18, 20 and 22 has its own inflation valve 24, so that each bladder can be inflated to a desired pressure. Hence, one can vary the bounce of the football by having at least the end bladders 18 and 22 at different pressures so that one end is softer than the other.

When fully inflated, the elongated football is more than two feet in length and preferably about forty inches or one meter long, and no more than about ten inches in maximum diameter. Laces or simulated laces 26 are provided along each seam line 16 at each end of the football 10 so that the ball may be grasped and thrown away any end and wherever gripped around its girth.

The casing is preferably of a relatively soft material to minimize risk of injury, and at each end may contain different weights of a soft putty or the like for variable end weighting. Also if desired, the ends of the casing may be of different colors, and points may be scored by throwing the ball to a contact area with the specified color striking first.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. An elongated football comprising:

a casing formed of at least four elongated panels with seam lines therebetween extending end to end;

transverse partitions means within and across said casing forming three compartments in tandem in said casing; and three inflatable bladders contained in said casing, each of said bladders being contained in one of said compartments and having an inflating valve accessible from the outside of said casing so that said bladders can be inflated to different pressures;

two of said bladders at opposite ends of said casing being generally conical;

said casing, when said bladders are inflated, being in length at least three times its maximum diameter.

2. The elongated football defined by claim 1 including:

means forming at least one row of roughened finger grips at each end of said casing.

3. The elongated football defined by claim 1 including:

a row of roughened finger grips along at least two of said seam lines at each end of said casing.

4. The elongated football defined by claim 3 wherein:

there are five panels in said casing; and there are roughened finger grips along each of said seam lines at both ends of said casing.

5. The elongated football defined by claim 1 including:

a weighted member in said casing at at least one end thereof.

* * * * *